US006085808A

United States Patent [19]

Hager et al.

[11] Patent Number: 6,085,808

[45] Date of Patent: Jul. 11, 2000

[54] LIQUID SOLVENT TRANSPORTATION PROCESS

[75] Inventors: James L. Hager, Seymour; Brian K. Schneider, Wheaton, both of Wis.

[73] Assignee: WRR Environmental Services Co., Inc., Eau Claire, Wis.

[21] Appl. No.: 08/898,823

[22] Filed: Jul. 23, 1997

[51] Int. Cl.[7] ..... B65B 1/04

[52] U.S. Cl. ..... 141/231; 141/65; 222/1; 222/608

[58] Field of Search ..... 141/231, 65, 95, 141/1; 222/1, 608

[56] References Cited

U.S. PATENT DOCUMENTS 4,938,315 7/1990 Ohta et al. ..... 184/1.5

5,052,443 10/1991 Evangelist, Jr. ..... 141/231

5,370,160 12/1994 Parker ..... 141/65

*Primary Examiner*—Steven O. Douglas

[57] ABSTRACT

A process for safely and efficiently transporting flammable or combustible solvents is disclosed. A covered trailer contains an empty container for contaminated solvent and a container full of non-contaminated solvent. The trailer moves from point to point removing contaminated solvent from a users drum container and filling the users drum container with fresh solvent. When either the contaminated solvent container is full or the non-contaminated solvent container is empty, the trailer moves to the distributors recovery/disposal facility to discharge the contaminated solvent and replenish the non-contaminated solvent tank for further servicing of users drum containers.

20 Claims, No Drawings

LIQUID SOLVENT TRANSPORTATION PROCESS

FIELD OF THE INVENTION

This invention relates to a process for safely and efficiently transporting fluids and more particularly to transporting flammable or combustible solvents.

BACKGROUND OF THE INVENTION

The transportation of fluids from point to point has always entailed a number of problems. The fluid must first be loaded into a suitable container which is placed on, or already secured upon, a means of transportation which then moves from one point to another. Then the fluid is unloaded at the destination.

Various methods and apparatus were developed for the transportation of particular fluids. Flammable or combustible liquids require special precautions in their transportation. Liquids such as gasoline or fuel oil are transported to a central storage facility via pipeline, ship or rail car. Smaller tanker vehicles then distribute the material to individual point of use, such as gasoline stations or private dwellings. The liquids are transferred from the tanker vehicle to a smaller container via a hose for temporary storage until needed at the point of use. Smaller volumes of liquids are packed in metal drums, ranging from 5 to 55 gallons, at a central distribution point. The drums are placed in a vehicle and delivered to the point of use where empty drums are picked up at the same time. Handling the drums at both the distribution point and the multiple points of use require significant time and effort. Likewise, the chance of leakage of liquid from the drums due to damage or corrosion is of concern, particularly for flammable or combustible liquids. Recently the federal government Department of Transportation (DOT) has mandated special testing for 16 and 30 gallons capacity metal drums used in transporting flammable or combustible liquids between each use. The situation is particularly problematical for one industry sector, the facility which employs small volume, 5 to 55 gallons, of combustible or flammable liquid for parts washing. Not only must fresh liquid be transported to the point of use, but contaminated liquid must be transported back to the distributor for recovery or disposal. The regulations thus make the use of these containers even more costly for the point of use owner.

Applicants have devised a process for safely and economically transporting contaminated and non-contaminated flammable or combustible liquids between a number of points of use and a point of recovery or disposal. The process overcomes the problems of leakage or spillage of the flammable or combustible liquid during transportation, as well as complying with the DOT regulations regarding special testing of the smaller volume drums between each use.

SUMMARY OF THE INVENTION

The invention comprises a process for safely and efficiently transporting contaminated and non-contaminated fluid between a plurality of points of use and a point of fluid recovery or disposal. At least one first container of first selected volume for non-contaminated fluid is provided, with the first container positioned within a mobile transportation unit. At least one second container of second selected volume for contaminated fluid is provided, with the second container also positioned within the mobile transportation unit. The first container within the mobile transportation unit is filled with the first selected volume of non-contaminated fluid.

The mobile transportation unit moves to a first selected point of use for the fluid, where a third selected volume of the contaminated fluid is transferred from a third container located at the first selected point of use, to the second container positioned within the mobile transportation unit to produce an empty third container.

A like third selected volume of non-contaminated fluid from the first container in the mobile transportation unit is transferred to the empty third container at the first selected point of use. The mobile transportation unit then moves to a second point of use, then to successive points of use and repeats the transfer of contaminated fluid to the second container and filling of the third container at each point of use until the first container is empty of non-contaminated fluid or the second container is full of contaminated fluid. The mobile transportation unit then moves to the point of fluid recovery or disposal, emptying the contaminated fluid from the second tank, and refilling the first tank with additional non-contaminated fluid.

DESCRIPTION OF THE PREFERRED EMBODIMENTS

The invention is a process for safely and efficiently transporting both contaminated and non-contaminated fluid, such as a flammable or combustible solvent, between a central distribution point, a number of points of use, and a point of recovery or disposal. As mentioned above, the small shops which use limited volumes (5 to 55 gallons) of flammable or combustible liquids in their parts washing setup find the process most useful. The preferred solvent is a petroleum naphtha solvent.

The parts washing setup is made up of a 16 to 30 gallon capacity drum of solvent with a shallow tray mounted atop the drum. A pump brings fresh solvent from the drum to the shallow tray to contact and clean the dirty parts. The solvent, containing dissolved grease and oil, and other debris, then flows back to the drum where the insoluble particles settle to the bottom. The pump intake is located a selected distance above the bottom of the drum so as not to draw up the particles collected there. As usage of the parts washer continues, the solvent becomes progressively more contaminated. The solvent in the drum must be replaced by fresh solvent for continued use of the parts washer.

The shop user could retain a second drum of fresh solvent or have a distributor supply a fresh drum of solvent. The contaminated solvent ultimately must be either recycled or disposed of, often by the distributor. The above scenario results in transporting 16, 30 or 55 gallon drums of solvent to and from the point of use, as well as the mandated testing between each use of the drums. Leakage and spillage of solvent during transportation is also of concern. To overcome these problems, applicants invention is the following process.

At least one first container for non-contaminated fluid is positioned within a mobile transportation unit. The first container is preferably a 500 gallon capacity stainless steel tank which meets DOT specification 57. The tank is positioned within a conventional covered trailer unit powered by a conventional tractor vehicle and fitted with an outlet conduit which feeds an explosion proof pump to deliver non-contaminated solvent through an attached hose as needed by the system operator. An additional first tank of similar size and manufacture may be positioned within the trailer as well.

At lease one second container for contaminated fluid is also positioned within the mobile transportation unit. The second container is preferably a 1,500 gallon capacity carbon steel tank which meets specifications MC 307/DOT 407. The second container tank is designed for vacuum operation and fitted with an explosion proof blower which generates a vacuum within the second container. The blower is attached to an outlet of the second container with primary and secondary filters positioned in the outlet line between the blower and second container to protect the blower from contaminated fluid therein. The primary and secondary filters are preferably cartridge filters. An inlet line to the second container is attached to a flexible wand used as described below.

The first container positioned within the trailer unit is filled with a selected volume of non-contaminated fluid, as is each additional first container located therein. The second container is initially empty.

The trailer unit is moved by the tractor vehicle from the starting point, preferably the distributors location, to a first selected point of use, i.e. a first small shop. The operator activated the blower to produce a vacuum within the second container. The flexible wand is inserted to the bottom of the small drum of the parts washer, and essentially the complete volume of that drum is transferred to the second container in the trailer. In practice, the 16 and 30 gallon drums are not completely full when in use, thus only about 10 or 20 gallons of solvent are transferred from each sized drum respectively. The transfer is sufficiently rapid that all of the settled particles and sediment are carried along into the second container. The wand may optionally be fitted with a screen over the intake end to prevent excessively large debris from entering the second vacuum container. The wand is removed from the small drum and a like volume of non-contaminated liquid is dispensed from the first container by the pump and flexible delivery hose. Thus, the contaminated fluid in the parts washer has been replaced with fresh solvent without transporting liquid in small drums. The operator also carries extra empty small drums in the trailer unit as replacements should the point of use drum be damaged corroded or develop a leak.

The trailer with containers therein is then moved by the tractor vehicle to a second point of use and the process is again repeated. This continues until either the contaminated fluid container is full or all of the non-contaminated fluid in the first container has been dispensed. The trailer and tractor vehicle then travel back to a point of fluid recovery or disposal for the contaminated liquid where the second tank is emptied and the first tank is refilled with non-contaminated liquid. The unit is then ready to travel to additional points of use.

Thus the process avoids the problems of leakage and/or spillage of a flammable or combustible liquid within the transportation vehicle or at the point of use, the need to retest small volume drums between use, as well as saving operator time and effort at each point of use.

While the invention is described for use with a fluid which is a flammable or combustible liquid, the fluid may be a water based liquid which becomes contaminated during use and requires cautious handling involved in recycling or disposal of this liquid.

The foregoing description of the preferred embodiments of the invention have been presented for purposes of illustration and description. It is not intended to be exhaustive or to limit the invention to the precise form disclosed and obviously many modifications and variations are possible in light of the above teaching. It is intended that the scope of the invention be defined by the claims appended hereto.

We claim:

1. A process for safely and efficiently transporting contaminated and non-contaminated fluid between a plurality of points of use and a point of fluid recovery or disposal comprising:

a) providing at least one first container of first selected volume for non-contaminated fluid, said first container positioned within a mobile transportation unit which is motorized and arranged for over-the-road travel;

b) providing at least one second container of second selected volume for contaminated fluid, said second container also positioned within said mobile transportation unit;

c) filling said first container within said mobile transportation unit with said first selected volume of non-contaminated fluid;

d) moving said mobile transportation unit to a first selected point of use for said fluid;

e) transferring a third selected volume of said contaminated fluid from a third container located at said first selected point of use, to said second container positioned within said mobile transportation unit to produce an empty third container;

f) transferring a like third selected volume of said non-contaminated fluid from said first container in said mobile transportation unit to said empty third container at said first selected point of use;

g) moving said mobile transportation unit from said first point of use to a second selected point of use and repeating steps e) and f);

h) moving said mobile transportation unit to successive points of use and repeating steps e) and f) until said first container is empty of non-contaminated fluid or said second container is full of contaminated fluid; and i) moving said mobile transportation unit to said point of fluid recovery or disposal, emptying said contaminated fluid from said second tank therein, and refilling said first tank therein with additional non-contaminated fluid.

2. A process according to claim 1 wherein said fluid is a flammable or combustible liquid.

3. A process according to claim 1 wherein said fluid is a petroleum naphtha solvent.

4. A process according to claim 1 wherein said first selected volume of said first container is about 500 gallons.

5. A process according to claim 1 wherein said second selected volume of said second container is about 1,500 gallons.

6. A process according to claim 1 wherein said third selected volume transferred from and returned to said third container is about 10 gallons to about 20 gallons.

7. A process according to claim 1 wherein said second container is a vacuum vessel.

8. A process according to claim 1 wherein said transferring of contaminated fluid from said third container to said second container is by activating a blower connected to an outlet of said second container, thereby drawing said contaminated fluid through a wand and flexible hose connected to an inlet of said second container.

9. A process according to claim 1 wherein said transferring of non-contaminated fluid from said first container to said third empty container is by activating a pump connected to an outlet of said first container, thereby pumping said non-contaminated fluid through a flexible hose connected to said pump and into said third container.

10. A process according to claim 1 wherein said mobile transportation unit is a covered trailer moved by a tractor vehicle.

11. A process for safely and efficiently transporting contaminated and non-contaminated combustible liquid between a plurality of points of use and a point of combustible liquid recovery or disposal comprising:

a) providing at least one first container of first selected volume for non-contaminated combustible liquid, said first container positioned within a mobile transportation unit which is motorized and arranged for over-the-road travel;

b) providing at least one second container of second selected volume for contaminated combustible liquid, said second container also positioned within said mobile transportation unit;

c) filling said first container within said mobile transportation unit with said first selected volume of non-contaminated combustible liquid;

d) moving said mobile transportation unit to a first selected point of use for said combustible liquid;

e) transferring a third selected volume of said contaminated combustible liquid from a third container located at said first selected point of use, to said second container positioned within said mobile transportation unit to produce an empty third container;

f) transferring a like third selected volume of said non-contaminated combustible liquid from said first container in said mobile transportation unit to said empty third container at said first selected point of use;

g) moving said mobile transportation unit from said first point of use to a second selected point of use and repeating steps e) and f);

h) moving said mobile transportation unit to successive points of use and repeating steps e) and f) until said first container is empty of non-contaminated combustible liquid or said second container is full of contaminated combustible liquid; and i) moving said mobile transportation unit to said point of combustible liquid recovery or disposal, emptying said contaminated combustible liquid from said second tank therein, and refilling said first tank therein with additional non-contaminated combustible liquid.

12. A process according to claim 11 wherein said combustible liquid is a petroleum naphtha solvent.

13. A process according to claim 11 wherein said first selected volume of said first container is about 500 gallons.

14. A process according to claim 11 wherein said second selected volume of said second container is about 1,500 gallons.

15. A process according to claim 11 wherein said third selected volume transferred from and returned to said third container is about 10 gallons to about 20 gallons.

16. A process according to claim 11 wherein said second container is a vacuum vessel.

17. A process according to claim 11 wherein said transferring of contaminated combustible liquid from said third container to said second container is by activating a blower connected to an outlet of said second container, thereby drawing said contaminated combustible liquid through a wand and flexible host connected to an inlet of said second container.

18. A process according to claim 11 wherein said transferring of non-contaminated combustible liquid from said first container to said third empty container is by activating a pump connected to an outlet of said first container, thereby pumping said non-contaminated combustible liquid through a flexible hose connected to said pump and into said third container.

19. A process according to claim 11 wherein said mobile transportation unit is a covered trailer moved by a tractor vehicle.

20. A process for safely and efficiently transporting contaminated and non-contaminated petroleum naphtha between a plurality of points of use and a point of petroleum naphtha recovery or disposal comprising:

a) providing at least one first container of first selected volume for non-contaminated petroleum naphtha, said first container positioned within a mobile transportation unit;

b) providing at least one second container of second selected volume for contaminated petroleum naphtha, said second container also positioned within said mobile transportation unit;

c) filling said first container within said mobile transportation unit with said first selected volume of non-contaminated petroleum naphtha;

d) moving said mobile transportation unit to a first selected point of use for said petroleum naphtha;

e) transferring a third selected volume of said contaminated petroleum naphtha from a third container located at said first selected point of use, to said second container positioned within said mobile transportation unit to produce an empty third container;

f) transferring a like third selected volume of said non-contaminated petroleum naphtha from said first container in said mobile transportation unit to said empty third container at said first selected point of use;

g) moving said mobile transportation unit from said first point of use to a second selected point of use and repeating steps e) and f);

h) moving said mobile transportation unit to successive points of use and repeating steps e) and f) until said first container is empty of non-contaminated petroleum naphtha or said second container is full of contaminated petroleum naphtha; and i) moving said mobile transportation unit to said point of petroleum naphtha recovery of disposal, emptying said contaminated petroleum naphtha from said second tank therein, and refilling said first tank therein with additional non-contaminated petroleum naphtha.

* * * * *